US005855765A

United States Patent [19]

Morgan

[11] Patent Number: 5,855,765

[45] Date of Patent: Jan. 5, 1999

[54] PROCESS FOR DEZINCING GALVANIZED STEEL USING AN ELECTRICALLY ISOLATED CONVEYOR

[75] Inventor: William A. Morgan, Hamilton, Canada

[73] Assignee: Metal Recovery Industries, Inc., East Chicago, Ind.

[21] Appl. No.: 680,345

[22] Filed: Jul. 17, 1996

[51] Int. Cl.[6] ..... C25F 5/00

[52] U.S. Cl. ..... 205/706; 205/717; 205/741

[58] Field of Search ..... 205/706, 712, 205/717, 741

[56] References Cited

U.S. PATENT DOCUMENTS

| | | | |
|---|---|---|---|
| 2,973,307 | 2/1961 | Hahn | 205/717 |
| 3,394,063 | 7/1968 | Blume | 205/717 |
| 3,492,210 | 1/1970 | Bowers et al. | 205/717 |
| 3,905,882 | 9/1975 | Hudson et al. | 204/119 |
| 4,172,773 | 10/1979 | Pellegri et al. | 205/743 |
| 4,710,277 | 12/1987 | Dyvik et al. | 204/119 |
| 5,106,467 | 4/1992 | Leeker et al. | 204/114 |
| 5,302,260 | 4/1994 | LeRoy et al. | 205/706 |
| 5,302,261 | 4/1994 | LeRoy et al. | 204/146 |
| 5,407,544 | 4/1995 | Oehr et al. | 205/712 |

*Primary Examiner*—Arun S. Phasge

*Attorney, Agent, or Firm*—Senniger, Powers, Leavitt & Roedel

[57] ABSTRACT

A process for removing zinc from galvanized steel. The galvanized steel is immersed in an electrolyte containing at least about 15% by weight of sodium or potassium hydroxide and having a temperature of at least about 75° C. and the zinc is galvanically corroded from the surface of the galvanized steel. The material serving as the cathode is principally a material having a standard electrode potential which is intermediate of the standard electrode potentials of zinc and cadmium in the electrochemical series. The steel scrap is carried through the electrolyte by a conveyor which is electrically isolated from ground and which comprises a cathodic material which has a standard electrode potential which is intermediate of the standard electrode potentials of zinc and cadmium in the electrochemical series.

4 Claims, 1 Drawing Sheet

PROCESS FOR DEZINCING GALVANIZED STEEL USING AN ELECTRICALLY ISOLATED CONVEYOR

BACKGROUND OF THE INVENTION

The present invention relates, in general, to a process for dezincing steel scrap and, in particular, to a galvanic dezincing process in which the cathode is steel or another metal or alloy which does not have a low hydrogen overvoltage.

Zinc coated (galvanized) steel is widely used in automotive, construction, and agricultural equipment and other industries. These industries and the mills producing galvanized sheet generate a considerable quantity of fresh steel scrap, at least some of which is galvanized, which can be recycled and reused as a starting material in steel and iron-making processes. The presence of zinc in the steel scrap used in steel and iron-making processes, however, increases the cost of compliance with environmental regulations due to costs associated with dust disposal and possible pretreatment of dust as a hazardous waste, treatment of waste water for removal of zinc and collection of fumes to maintain the shop floor environment and to restrict roof-vent emissions. As a result, there is great interest in development of an economical method of removing zinc from steel scrap.

In one approach, the steel scrap is immersed in an acid such as hydrochloric acid or sulfuric acid. Iron, however, is co-dissolved with the zinc in the acid solution and the separation of the iron from the zinc has not been found to be economically feasible.

The use of caustic soda solution to dissolve zinc from galvanized steel scrap has also been proposed. An inherent advantage of this method is that iron is stable in caustic and thus, separation of iron from zinc in solution is not a significant problem. A disadvantage of this method, however, is the relatively slow rate at which zinc is removed from the galvanized surface which leads to low productivity or inadequate zinc removal.

Leeker et al. in U.S. Pat. No. 5,106,467 disclose a process for the dissolution of zinc from galvanized steel in caustic electrolyte in which the dissolution rate is accelerated by the addition of oxidizing agents such as sodium nitrate to the electrolyte. The use of nitrates, however, increases the cost of the process. In addition, the use of nitrates has been associated with the formation of cyanides and thus this approach poses a serious risk hazard.

LeRoy et al. disclose other methods for accelerating the dissolution of zinc from galvanized steel in caustic electrolyte in U.S. Pat. Nos. 5,302,260 and 5,302,261. LeRoy et al. suggest that the galvanized steel be immersed in a caustic electrolyte and electrically connected to a cathodic material which is stable in the electrolyte and which has a low hydrogen overvoltage. According to LeRoy et al., such cathodes include high-surface-area nickel-based and cobalt-based materials such as Raney nickel type and Raney Cobalt type, nickel molybdates, nickel sulfides, nickel-cobalt thiospinels and mixed sulphides, nickel aluminum alloys, and electroplated active cobalt compositions. If the scrap is clean, unpainted, or shredded, no external source of voltage is applied to the cathode material. LeRoy et al., U.S. Pat. No. 5,302,261 at col. 2, lines 37–47. If bundles of scrap are to be dezinced, however, they suggest applying an external source of voltage to the cathode to increase the rate of zinc stripping. LeRoy et al., U.S. Pat. No. 5,302,261 at col. 2, lines 47–54. The anodic dezincing of bundles or bales, however, requires large processing times, floor space and concomitant capital and electrical power costs, making this process relatively expensive. The cost of cathodic materials having a low hydrogen overvoltage also adds significantly to the cost of this approach.

SUMMARY OF THE INVENTION

Among the objects of the invention, therefore, is the provision of a process for dezincing steel scrap in a caustic electrolyte; the provision of such a process in which the cathode is steel or another metal having a relatively high hydrogen overvoltage; the provision of such a process in which an external source of voltage need not be applied to the cathode material to increase the dissolution rate; and the provision of such a process in which the zinc removal rate is accelerated relative to the rate at which zinc would be removed from scrap which is simply immersed in caustic electrolyte.

Briefly, therefore, the present invention is directed to a process for removing zinc from galvanized steel. The galvanized steel is immersed in an aqueous electrolyte containing sodium or potassium hydroxide and the zinc is galvanically corroded from the surface of the galvanized steel. The material serving as the cathode is principally a material having a standard electrode potential which is intermediate of the standard electrode potentials of zinc and cadmium in the electrochemical series. The steel scrap is immersed in and/or carried through the electrolyte by a conveyor which is electrically isolated from ground and which comprises a cathodic material which is more noble than zinc, such as a steel alloy. In a preferred embodiment, the corrosion rate is accelerated by (i) increasing the number density of corrosion sites in the galvanized steel by mechanically abrading or deforming the galvanized steel, (ii) heating the galvanized steel to form an alloy of zinc on the surface of the galvanized steel, (iii) mixing the galvanized steel with a material having a standard electrode potential which is intermediate of the standard electrode potentials of zinc and cadmium in the electrochemical series, or (iv) moving the galvanized steel relative to itself and to the electrolyte while immersed in the electrolyte.

Other objects and features of the invention will be in part apparent and in part pointed out hereinafter.

DETAILED DESCRIPTION OF THE INVENTION

Figure 1:
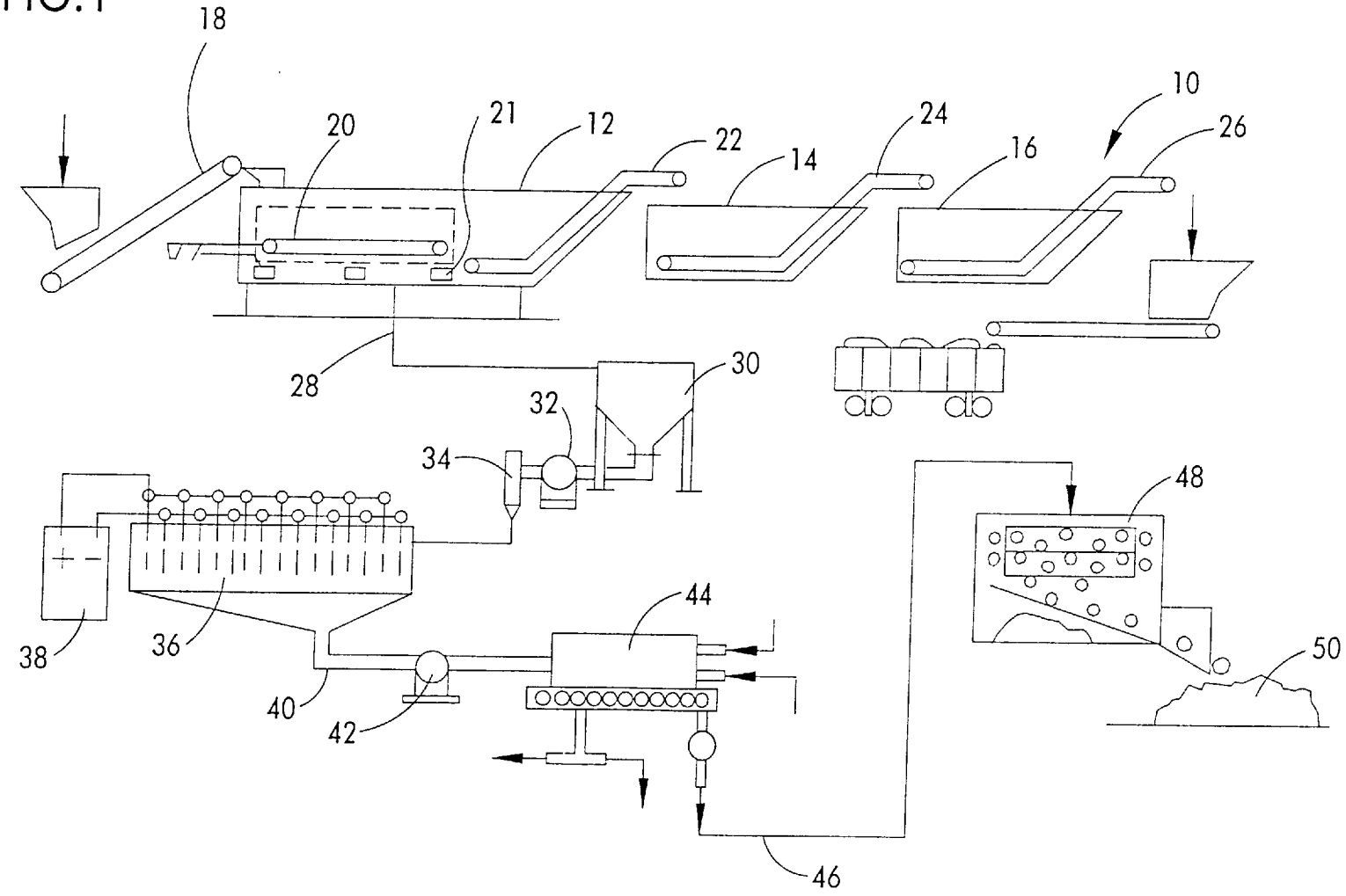
FIG. 1 is a schematic view illustrating steel scrap movement and caustic electrolyte circulation through a dezincing process of the present invention.

The process of the present invention is carried out in a system in which the steel scrap is immersed in a caustic electrolyte such as caustic soda (sodium hydroxide) or caustic potash (potassium hydroxide). Caustic soda is preferred over potassium hydroxide, however, due to its relative cost advantage. While immersed in the electrolyte, the zinc-coated steel is galvanically corroded with the zinc-coated surface of the scrap serving as the anodic material and an exposed steel surface or another metal having a relatively high hydrogen overvoltage serving as the cathodic material. To enable the galvanic corrosion process to proceed at an economically practical rate, the scrap is treated in a manner to increase the surface area of the cathodic material relative to the surface area of the anodic material.

In general, the rate of dissolution of the zinc increases with increasing concentration of the caustic soda in and the temperature of the electrolyte. Preferably, the electrolyte is an aqueous solution comprising caustic soda in a concentration of at least about 15% by weight. More preferably, the concentration of caustic soda in the electrolyte is between about 25% and about 50% by weight and most preferably it is maintained within the range of about 30% to 40% by weight. At these concentrations, the electrolyte can be relatively viscous depending upon the temperature. Accordingly, the temperature of the electrolyte is preferably at least 75° C. but less than the temperature at which the electrolyte boils, more preferably between about 85° C. and about 95° C., and most preferably between about 90° C. and about 95° C.

The cathodic material may be any metal or alloy which is more noble than zinc in the galvanic series of metals and alloys. High-surface-area nickel-based or cobalt-based materials, nickel molybdates, nickel sulfides, nickel-cobalt thiospinels and mixed sulphides, nickel aluminum alloys, and electroplated active cobalt compositions and any other such low-hydrogen overvoltage materials are too expensive and thus are preferably not used as the cathodic material. Instead, the cathodic material is principally iron, an alloy of steel, or another alloy or metal having a standard electrode potential (reduction potential) intermediate that of the standard electrode potential of zinc (−0.76 V) and cadmium (about −0.4 V) in the electrochemical series which is relatively inexpensive. In a particularly preferred embodiment, pieces of galvanized scrap or regions thereof from which the zinc coating has been removed serve as the cathodic material.

In accordance with the present invention, the size of the cathodic area relative to the size of the anodic area of the steel scrap may be increased by a variety of methods. For example, (i) the steel scrap may be heated or mechanically abraded or deformed to increase the number density and total surface area of cathodic areas in the scrap, or (ii) it may be intimately mixed with a cathodic material. Except as will be noted herein, these methods may be carried out before the scrap is immersed in the electrolyte or while it is immersed in the electrolyte.

In general, heating the surface of galvanized scrap to a relatively high temperature causes zinc from the zinc coating to diffuse into the steel and iron from the steel to diffuse into the zinc coating. As a result of this diffusion, electrical contact between two dissimilar metals is increased at the surface of the steel scrap thus increasing the galvanic corrosion rate of the scrap when it is immersed in the electrolyte. Preferably, the galvanized scrap is heated to a temperature in excess of the melting point of zinc in order for this transformation to occur in a commercially acceptable time period. More preferably, the galvanized scrap is heated to a temperature of at least about 470° C., still more preferably at least about 500° C., and most preferably at least about 600° C. The period of time at which the galvanized scrap is held at these temperatures to achieve the desired effect will be a function of temperature. In general, however, it is preferred that the holding period be between about 5 and about 20 minutes, with time periods of about 10 to 15 minutes being particularly preferred.

Alternatively, the steel scrap may be mechanically abraded or deformed to increase the galvanic corrosion rate. Abrading the steel scrap will remove the zinc from local areas. Deforming the steel scrap may crack or otherwise stress the zinc coating. Because these exposed and deformed areas are generally surrounded by zinc-coated regions, the number density and total surface area of cathodic areas in the scrap is increased at the surface of the steel scrap thus increasing the galvanic corrosion rate of the scrap when it is immersed in the electrolyte. The steel scrap may be mechanically abraded or deformed, for example, by shredding the scrap, by relative movement of the scrap against itself or another abrasive surface, or by hammer-milling it. Steel scrap is typically available in pieces ranging in size from about 2.5 to about 120 cm. with the majority of the pieces being about 10 to about 70 cm. If the steel scrap is shredded, therefore, the shredded pieces preferably have a size distribution of about 10 to about 20 cm., with the majority of shredded pieces having a size distribution of about 10 to about 15 cm. wherein size is determined by reference to the dimensions of square openings in a grate through which the pieces are passed. If the pieces of steel scrap are mechanically deformed, e.g., bent or scraped, it is preferred that the deformation sites be uniformly distributed over the galvanized surface and that, on average, the deformed surface area exceed about 10%, more preferably about 15%, and most preferably at least about 20% of the surface area of steel scrap.

In a further embodiment of the present, invention the size of the cathodic area may be increased relative to the size of the anodic area of the galvanized steel scrap by forming a mixture of galvanized steel scrap and uncoated material, i.e., a metal or alloy which is more noble than zinc in the galvanic series and which lacks a zinc coating. The mixture of uncoated material and galvanized steel scrap comprises at least about 5% by weight uncoated material, preferably at least about 10% uncoated material, more preferably at least about 20% uncoated material, and optimally at least about 30% uncoated material. Such mixtures may be available directly from some scrap producers or may be formed by mixing the galvanized steel scrap with uncoated material. In a preferred embodiment, the uncoated material is steel scrap from which the zinc coating has at least been partially removed.

In one embodiment of the present invention, the steel scrap is immersed in and/or carried through the electrolyte by a conveyor consisting essentially of a cathodic material which is more noble than zinc, such as a steel alloy. The conveyor may be, for example, an endless moving steel belt or a track with a carriage for holding the steel scrap suspended from the track.

In a preferred embodiment, the carriage is a rotating drum having openings in the wall thereof through which electrolyte can pass when it is immersed in the electrolyte. Rotation of the drum in the electrolyte causes movement of the steel scrap relative to itself and to drum which causes mechanical abrasion of the galvanized steel and acceleration of the galvanic corrosion rate. In addition, rotation of the drum causes the steel scrap to move relative to the electrolyte, thereby decreasing the thickness of the boundary layer and further accelerating the galvanic corrosion rate.

Referring now to FIG. 1, reference numeral 10 generally illustrates a preferred embodiment of an apparatus for carrying out the process of the present invention. Dezincing apparatus 10 comprises dezincing tank 12, rinse tanks 14, 16 and a series of endless moving belts 18, 22, 24 and 26. Steel scrap such as shredded loose clippings is fed to conveyor 18 which delivers the steel scrap to dezincing tank 12 which contains an aqueous sodium hydroxide solution containing from 150 grams/liter to 500 grams/liter NaOH at temperatures ranging from 50° C. to 100° C. Within dezincing tank 14, moving belt 20 is supported by pads 21 which, in addition, electrically isolate moving belt 20 from dezincing tank 12 and from ground. Immediately upon immersion of the mixed scrap into the electrolyte, a battery effect is created which is similar to the well known Lelande cell and the modern alkaline battery. The reaction proceeds rapidly (e.g., in 10 minutes or less) and vigorously when the temperature is greater than about 75° C. No external voltage needs to be supplied to loose scrap; the reaction is self-sustaining until the zinc has dissolved yielding what is conventionally known as "black" or dezinced scrap. Close proximity of a clean steel surface to a zinc coated surface accelerates the process.

Moving belt 20 delivers the black scrap to moving belt 22 which carries the black scrap up and out of dezincing tank 12 and delivers it onto moving belt 24. Moving belt 24 carries the scrap through rinse tank 24 and delivers the rinsed scrap onto moving belt 26 which carries the scrap through rinse tank 26 for a second rinsing. The rinsed, black scrap is then transferred to a storage bin or directly to a customer.

Electrolyte containing dissolved zinc is continuously withdrawn from dezincing tank 12 via line 28, purified to remove aluminum, lead, copper, bismuth and iron in a tank 30, pumped by slurry pump 32, filtered in a vacuum drum or other suitable filter 34 and delivered to electrolytic zinc recovery cell 36 connected to a transformer rectifier 38. In electrolytic zinc recovery cell 36, the zinc metal is deposited on the cathode (e.g., a magnesium cathode) as a powder and/or in dendritic form and is continuously caused to be removed from the cathode to settle to the bottom of the electrolysis cell. From zinc recovery cell 36, zinc metal powder slurry is withdrawn and pumped via line 40 and slurry pump 42 to filter 44 (or centrifuge). Damp zinc cake discharged from horizontal tank filter 44 is transferred by line 46 to a briquetting unit 48 which produces zinc powder briquettes 50 which are ready for storage or sale to a customer. The electrolytic process regenerates caustic soda which is returned to the dezincing tank; the spent electrolyte with a reduced zinc content (i.e., less than about 20 gm./l of zinc) is returned to the dezincing tank for further use. Preferred operating temperatures for the electrolysis solutions are about 30° to about 45° C. and an input range of about 25 to about 40 grams/liter of zinc with a free caustic level of about 150 to about 300 grams/liter of NaOH.

Tests on approximately 1,000 tons of material comprising hot dipped zinc steel, electrolytically zinc coated steel, galvanneal, galvalume, galfan, zinc iron coated, zinc nickel coated and terne (lead coated steel) plate have been carried out. Starting zinc coating weights have ranged from an average of 0.5% to 7% zinc by weight and resulting residual coatings have been reduced to as little as 0.002% zinc by weight, with the average being about 0.02% by weight zinc.

Experience to date has also demonstrated that the removal rate of zinc can be increased by deforming the surface of the scrap prior to immersion in the tank of sodium hydroxide solution with dezincing times being reduced from 80 minutes to less than 20 minutes. The dezincing effect starts at the deformed site on the steel, e.g. a bend or scratch and proceeds across the surface of the steel. It has been demonstrated that the greater the number of these deformed sites the greater the improvement in rate of effectiveness of the process, e.g., if the steel is shredded into smaller pieces in a hammer mill. This creates sites of high energy (deformation) and areas where zinc has been mechanically removed in close proximity to coated areas. In all of the above cases the galvanic dezincing effect is enhanced. No external current or oxidant need to be used.

A further improvement in the process can be achieved by heating the coated steel prior to feeding it into the dezincing tank. This can be achieved by passing the steel through a heated furnace on a moving grate at 400° C. to 800° C. and feeding the hot material into the solution. These post-heated materials assist in effectively heating the dezincing solution, achieve the temperature of the electrolyte much earlier than colder materials, and the hot surfaces cause rapid convection movement of the solution across the surface of the steel thus reducing diffusion gradients of the zinc into the solution boundary layer.

Experience to date has shown that when a sheet of zinc coated steel is dezinced the portion of the sheet that has been heated is dezinced before the unheated part of the sheet is dezinced. Extending the above effects of heating and deformation the process can be best performed by charging the materials to be dezinced by feeding them to a shredder such as a hammer mill which is operated both to deform the steel, mechanically remove zinc from part of the surface and concurrently heat the steel to a dull red heat.

In the process outlined in FIG. 1, a flat linear conveyor is used and there is little movement between the adjacent pieces of steel scrap. Thus there could be areas that shield each other from the solution and cause "dead" zinc concentrated areas where reaction is slowed. This can be avoided by vigorous agitation and recycling of the hot solution or alternatively it may be overcome by using a rotating drum instead of a flat conveyor. When fitted with lifters or inclined at an angle, the rotating drum will tumble the steel moving each piece relative to the other, mix the solution, cause one surface to abrade against others, remove concentrated boundary layers, and ensure that the coated surfaces are more likely to "see" a clean steel surface. This arrangement can also cause the steel to be moved thorough the solution and continuously discharged.

EXAMPLE 1

In this test, hot dipped steel scrap (2.4% Zn) having a size about 5 to 10 centimeters was galvanically corroded in a dezincing bath consisting of an aqueous solution containing 30% by weight NaOH maintained at a temperature of 180° F. (82° C.). The steel scrap was immersed and carried through the dezincing bath by a horizontally moving steel plate (the steel scrap being static thereon) or by a rotating steel drum (in which the steel scrap was tumbled). The residual zinc content was analyzed for a variety of times in the dezincing bath. The results are presented in Table 1.

TABLE 1

| Time (min) | Operating Conditions | Residual Zinc (%) |
|---|---|---|
| 5 | static | 2.3 |
| 5 | tumbling | 1.8 |
| 10 | static | 1.9 |
| 10 | tumbling | 0.9 |
| 15 | static | 1.4 |
| 15 | tumbling | 0.4 |
| 30 | static | 0.9 |
| 30 | tumbling | 0.06 |
| 45 | static | 0.15 |
| 45 | tumbling | 0.006 |

EXAMPLE 2

In this test, hot dipped steel scrap (2.4% Zn) having a size of about 5 to 10 centimeters was galvanically corroded in a dezincing bath consisting of an aqueous solution containing 30% by weight NaOH maintained at a temperature of 180° F. (82° C.). Prior to being immersed in the dezincing bath, some of the samples were heated to a temperature of 600° C. while others were not. All of the steel scrap, however, was immersed in and carried thorough the dezincing bath by a rotating steel drum in which the steel scrap was tumbled.

The residual zinc content was analyzed for a variety of times in the dezincing bath. The results are presented in Table 2.

TABLE 2

| Time (min.) | Preheating Temperature | Residual Zinc (%) |
|---|---|---|
| 5 | 600° F. | 0.9 |
| 5 | no pre-heating | 1.9 |
| 10 | 600° F. | 0.15 |
| 10 | no preheating | 1.6 |
| 20 | 600° F. | 0.006 |
| 20 | no preheating | 0.48 |

EXAMPLE 3

In this test, hot dipped galvanneal steel scrap (2.5% Zn) having a size of about 7.5 to about 4 centimeters was galvanically corroded in a dezincing bath consisting of an aqueous solution containing 30% by weight NaOH maintained at a temperature of 80° C. The steel scrap was either carried through the dezincing bath by a horizontally moving steel plate (the steel scrap being static thereon) or by a rotating steel drum (in which the steel scrap was tumbled) immersed in the dezincing bath. The residual zinc content was analyzed for a variety of times in the dezincing bath. The results are presented in Table 3.

TABLE 3

| TIME (MINUTES) | RESIDUAL ZINC PERCENT | |
|---|---|---|
| IN SOLUTION | LINEAR | ROTARY |
| 5 | 2.30 | 2.05 |
| 10 | 2.10 | 1.35 |
| 20 | 1.10 | 0.16 |
| 30 | 0.34 | 0.05 |
| 40 | 0.08 | 0.003 |
| 60 | 0.02 | 0.003 |
| 80 | 0.02 | 0.003 |

Note that the dezincing rate is faster in the rotary drum even at short immersion times because the pieces of steel move relative to each other, thus assisting the diffusion rate of the zinc from the surface into the NaOH solution and enable the zinc coated ares to "see" more clean steel surfaces than in the linear movement where, although the solution is agitated the pieces of steel do not move relative to each other.

EXAMPLE 4

The tests of Example 3 were repeated, except that the temperature of NaOH solution was 95° C. The results are presented in Table 4.

TABLE 4

| Time (Minutes) | Residual Zinc Percent | |
|---|---|---|
| in Solution | Linear | Rotary |
| 5 | 2.32 | 2.01 |
| 10 | 1.81 | 1.24 |
| 20 | 0.34 | 0.04 |
| 30 | 0.061 | 0.003 |
| 40 | 0.008 | 0.001 |
| 60 | 0.008 | 0.001 |

EXAMPLE 5

The tests of Example 3 were repeated, except that galvalume (Zn-Al) coated steel with a coating of 1.4% zinc was used for all tests. The results are presented in Table 5.

TABLE 5

| Time (Minutes) | Residual Zinc Percent | |
|---|---|---|
| in Solution | Linear | Rotary |
| 5 | 1.31 | 1.24 |
| 10 | 0.74 | 0.43 |
| 20 | 0.13 | 0.08 |
| 30 | 0.011 | 0.003 |
| 40 | 0.009 | 0.003 |
| 60 | 0.009 | 0.001 |
| 80 | 0.008 | 0.001 |

Removal rates in this test are greater than those in Example 3 in both linear and rotary units because the zinc is alloyed with aluminum in the galvalume coatings. The rotary unit dezincs faster than the linear unit.

EXAMPLE 6

The test of Example 1 was repeated, except that the temperature of the NaOH solution was increased to 95° C. The results are presented in Table 6.

TABLE 6

| Time (Minutes) | Residual Zinc Percent | |
|---|---|---|
| in Solution | Linear | Rotary |
| 5 | 2.10 | 1.81 |
| 10 | 1.41 | 0.60 |
| 20 | 0.13 | 0.006 |
| 30 | 0.04 | 0.001 |
| 40 | 0.006 | 0.001 |
| 60 | 0.004 | 0.001 |

EXAMPLE 7

In this test, hot dipped steel scrap (2.4% Zn) was galvanically corroded in a dezincing bath consisting of an aqueous solution containing 30% by weight NaOH maintained at a temperature of 180° F. (82° C.). The steel scrap was immersed in and carried through the dezincing bath by a rotating steel drum in which the steel scrap was tumbled. Some of the scrap was placed in the drum in the size as provided, i.e., pieces having a size of about 10 to 20 centimeters whereas the remainder of the scrap was shredded to a size of about 4 to 8 centimeters in a hammer mill prior to being placed in the drum. The residual zinc content was analyzed for a variety of times in the dezincing bath. The results are presented in Table 7.

TABLE 7

| TIME IN DEZINCING BATH MINUTES | TEMPERATURE °F. | PRIOR DEFORMATION | RESIDUAL ZINC % |
|---|---|---|---|
| 5 | 180 | No | 1.8 |
| 5 | 180 | SHREDDED | 0.6 |
| 10 | 180 | No | 0.9 |
| 10 | 180 | SHREDDED | 0.13 |
| 15 | 180 | No | 0.4 |
| 15 | 180 | SHREDDED | 0.11 |

TABLE 7-continued

| TIME IN DEZINCING BATH MINUTES | TEMPERA-TURE °F. | PRIOR DEFORMATION | RESIDUAL ZINC % |
|---|---|---|---|
| 20 | 180 | No | 0.24 |
| 20 | 180 | SHREDDED | 0.004 |
| 30 | 180 | No | 0.11 |
| 30 | 180 | SHREDDED | 0.001 |
| 40 | 180 | No | 0.016 |
| 40 | 180 | SHREDDED | 0.001 |

These tests demonstrate that shredding and pre-heating (see Examples 2 and 8) have approximately the same effect upon dezincing rate, decreasing the retention time in the dezincing solution by a factor of about 2 to reach a residual zinc level of about 0.1% or less.

EXAMPLE 8

The test of Example 2 was repeated except that some of the samples were heated to a temperature of 750° C. prior to being immersed in the NaOH solution. The results are presented in Table 8.

TABLE 8

| TIME IN DEZINCING BATH MINUTES | TEMPERA-TURE °F. | PREHEAT TEMPERATURE °C. | RESIDUAL ZINC % |
|---|---|---|---|
| 5 | 180 | No | 1.8 |
| 5 | 180 | 600 | 0.6 |
| 10 | 180 | No | 0.9 |
| 10 | 180 | 600 | 0.15 |
| 15 | 180 | No | 0.4 |
| 15 | 180 | 600 | 0.10 |
| 20 | 180 | No | 0.24 |
| 20 | 180 | 600 | 0.004 |
| 30 | 180 | No | 0.11 |
| 30 | 180 | 600 | 0.002 |
| 40 | 180 | No | 0.006 |
| 40 | 180 | 600 | 0.002 |
| 10 | 180 | No | 0.9 |
| 10 | 180 | No | 0.04 |
| 20 | 180 | No | 0.24 |
| 20 | 180 | 750 | 0.002 |
| 30 | 180 | No | 0.11 |
| 30 | 180 | 750 | 0.001 |

Both shredding and pre-heat have the same effect and decrease the retention time in dezincing by a factor of about 2.0 to reach a residual zinc level of 0.1% or less.

In view of the above, it will be seen that the several objects of the invention are achieved.

As various changes could be made in the above compositions and processes without departing from the scope of the invention, it is intended that all matter contained in the above description be interpreted as illustrative and not in a limiting sense.

What is claimed is:

1. A process of removing zinc from galvanized steel comprising immersing the galvanized steel in an aqueous electrolyte containing sodium or potassium hydroxide, galvanically corroding the zinc from the surface of the galvanized steel in a reaction in which there is an anode and a cathode, wherein the zinc serves as the anode and the material serving as the cathode is principally a material having a standard electrode potential which is intermediate of the standard electrode potentials of zinc and cadmium in the electrochemical series, conveying the galvanized steel through the electrolyte with a conveyor which is electrically isolated from ground and which serves as a cathode for the galvanic corrosion, the conveyor comprising a cathodic material which has a standard electrode potential which is intermediate of the standard electrode potentials of zinc and cadmium in the electrochemical series, and heating the galvanized steel to form an alloy on the surface of the galvanized steel to accelerate the corrosion rate of the zinc from the galvanized steel.

2. A process as set forth in claim 1 wherein the surface of the galvanized steel is heated to a temperature of at least about 470° C.

3. A process as set forth in claim 1 wherein the surface of the galvanized steel is heated to a temperature of at least about 600° C.

4. A process of removing zinc from galvanized steel comprising immersing the galvanized steel in an aqueous electrolyte containing sodium or potassium hydroxide, the electrolyte containing at least about 30% by weight of sodium hydroxide and having a temperature of at least about 85° C., galvanically corroding the zinc from the surface of the galvanized steel in a reaction in which there is an anode and a cathode, wherein the zinc serves as the anode and the material serving as the cathode is principally a material having a standard electrode potential which is intermediate of the standard electrode potentials of zinc and cadmium in the electrochemical series, conveying the galvanized steel through the electrolyte with a conveyor which is electrically isolated from ground and which serves as a cathode for the galvanic corrosion, the conveyor comprising a cathodic material which has a standard electrode potential which is intermediate of the standard electrode potentials of zinc and cadmium in the electrochemical series, and heating the galvanized steel to a temperature of at least about 470° C. to form an alloy on the surface of the galvanized steel to accelerate the corrosion rate of the zinc from the galvanized steel.

* * * * *